US008931841B2

(12) United States Patent
Kelm

(10) Patent No.: US 8,931,841 B2
(45) Date of Patent: Jan. 13, 2015

(54) SYNCHRONOUS MECHANISM FOR A CHAIR

(75) Inventor: Carsten Kelm, Ennigerloh (DE)

(73) Assignee: Johannes Uhlenbrock, Drensteinfurt (DE)

( * ) Notice: Subject to any disclaimer, the term of this patent is extended or adjusted under 35 U.S.C. 154(b) by 212 days.

(21) Appl. No.: 13/592,653

(22) Filed: Aug. 23, 2012

(65) Prior Publication Data

US 2013/0221718 A1 Aug. 29, 2013

(30) Foreign Application Priority Data

Aug. 25, 2011 (DE) ..... 10 2011 081 588

(51) Int. Cl.
*A47C 1/024* (2006.01)
*A47C 3/00* (2006.01)
*A47C 1/032* (2006.01)

(52) U.S. Cl.
CPC ..... *A47C 3/00* (2013.01); *A47C 1/03272* (2013.01)
USPC ..... 297/337; 297/301.1

(58) Field of Classification Search
USPC ..... 297/301.1, 301.3, 301.4, 301.6, 337
See application file for complete search history.

(56) References Cited

U.S. PATENT DOCUMENTS 4,709,962 A 12/1987 Steinmann
5,035,466 A * 7/1991 Mathews et al. ..... 297/337
5,556,163 A * 9/1996 Rogers et al. ..... 297/330
5,782,536 A * 7/1998 Heidmann et al. ..... 297/440.15
5,873,634 A * 2/1999 Heidmann et al. ..... 297/440.14
6,027,168 A * 2/2000 Crossman et al. ..... 297/337
6,945,605 B2 * 9/2005 Kinoshita et al. ..... 297/317
2006/0071525 A1 * 4/2006 Costaglia ..... 297/337

FOREIGN PATENT DOCUMENTS

DE 19921153 9/2000
DE 10219478 11/2003
DE 102007059986 6/2009
EP 0247311 12/1987

OTHER PUBLICATIONS

German Priority Search, Feb. 28, 2013.

* cited by examiner

*Primary Examiner* — Philip Gabler
(74) *Attorney, Agent, or Firm* — Greer, Burns & Crain Ltd.

(57) ABSTRACT

A synchronous mechanism for a chair, such as an office chair, including a base unit, a seat support arranged above and moveably on the base unit, a backrest support arranged on the base unit so as to be capable of being pivoted about a pivot axis oriented horizontally and in transverse direction of the chair, and a prestressing device. The prestressing device exerts a prestressing force acting upwards on the seat support and forwards on the backrest support. The seat support is connected to the base unit via a coupling mechanism providing movability of the seat support relative to the base unit. The coupling mechanism is arranged to positively control the movements of the seat support relative to the base unit such that the seat support can be moved back and forth on its own between positions which are parallel to one another when the backrest support is fixed.

19 Claims, 9 Drawing Sheets

SYNCHRONOUS MECHANISM FOR A CHAIR

BACKGROUND OF THE INVENTION

The invention relates to a synchronous mechanism for a chair, in particular for an office chair, comprising a base unit, a seat support, which is arranged above and moveably on the base unit, a backrest support, which is arranged on the base unit so as to be capable of being pivoted about a pivot axis, which is oriented horizontally and in transverse direction of the chair, and a prestressing device, wherein the prestressing device exerts a prestressing force, which acts upwards on the seat support and forwards on the backrest support, and wherein the seat support is connected to the base unit via a coupling mechanism, which provides for the movability of the seat support relative to the base unit.

The invention furthermore relates to a chair, in particular an office chair.

A chair comprising a synchronous mechanism is known from DE 199 31 099 A1. The movabilities of backrest and seat are mechanically coupled to one another via the synchronous mechanism. The synchronous mechanism comprises a base unit, via which the synchronous mechanism is fastened to a central chair column, wherein the chair column is provided with a star base comprising rollers on the bottom side. The padded seat is arranged on a seat support, which is embodied as seat pad plate and which is connected to the base unit via a coupling mechanism. On the bottom side of the seat pad plate, which faces the bottom, the coupling mechanism comprises bearing supports on which vertically oriented elongated holes are embodied, in which bearing journals, which are arranged on the base unit, are guided. A pressure spring arrangement, which exerts a prestressing force, which acts upwards on the seat pad plate, and a prestressing force, which acts forwards on the backrest, is supported on the bottom side of the seat pad plate. Because of this, it is attained that the prestressing force is a function of the weight of the respective person sitting on the chair, whereby the sitting comfort is to be improved.

The disadvantage of the synchronous mechanism according to DE 199 31 099 A1 is that the prestressing force, which acts on the backrest support, is a function of how the weight, which rests on the seat or the seat support, respectively, is distributed relative to the horizontal. In the event that a user of the chair sits only on the front edge, for example, or substantially on a rear area of the seat, the seat tilts about a horizontal axis, which is oriented in transverse direction of the chair. However, in the event that a user sits on the seat so as to be offset to a lateral area of the seat, the seat tilts about a horizontal axis, which is oriented in longitudinal direction of the chair. It is clear that the seat can be tilted in a random manner about both of these axes by means of such asymmetrical stresses, which equals a floating support of the seat. This floating support of the seat can have the effect, for example, that the seat pad plate is tilted such that at least one bearing journal, which is arranged on the base unit, hits against an upper end of the elongated hole, which is embodied on the respective bearing support, whereby a part of the weight, which rests on the seat, is supported directly by the base unit via this bearing journal, and is no longer available to compress the pressure spring of the pressure spring arrangement and thus to act on the synchronous mechanism for optimally adjusting the prestressing force. A considerable decline of the desired sitting comfort is associated with this.

SUMMARY OF THE INVENTION

It is an object of the invention to provide for a synchronous mechanism, by means of which a chair, in particular an office chair, can be produced, which offers optimal sitting comfort independent from the respective type of the weight-loading of the seat.

In the case of a synchronous mechanism of the aforementioned type, this object is solved according to the invention in that the coupling mechanism is embodied such that it positively controls the movements of the seat support relative to the base unit such that the seat support can be moved back and forth solely between positions, which are parallel to one another, when the backrest support is fixed.

With the synchronous mechanism or its coupling mechanism, respectively, according to the invention, it does not have an impact on the size of the prestressing force, in which area the stressing of the seat or of the seat support, respectively, takes place with the weight of a user. In particular, a tilting of the seat support about a horizontal axis never takes place, in response to any type of stressing of the seat support with the weight of a user, which would be associated with the above-mentioned disadvantage. Instead, the synchronous mechanism according to the invention makes it possible to create a chair, in particular an office chair, in the case of which the prestressing force is regulated optimally.

In the context of the invention, the prestressing device can encompass a pressure spring arrangement according to DE 199 31 099 A1, incorporated herein by reference, or an arrangement, which is designed differently, but which has substantially the same effect. What is important is only that the prestressing device is embodied and arranged such that it can be actuated by a movement of the seat support relative to the base unit.

According to an advantageous embodiment of the invention, the coupling mechanism encompasses a front joint arrangement, which is arranged in the front area of the seat support and a rear joint arrangement, which is arranged in the rear area thereof, wherein the front joint arrangement and the rear joint arrangement are coupled to one another mechanically such that a movement of the front joint arrangement effects a movement of the rear joint arrangement and vice versa. This mechanical embodiment of the coupling mechanism is very robust. The two joint arrangements are preferably embodied such that they prevent a tilting of the seat support about an axis, which is oriented in the longitudinal direction of the chair. The mechanical coupling of the front joint arrangement to the rear joint arrangement preferably has the effect that the seat support cannot be tilted about an axis, which is oriented in transverse direction of the chair.

According to a further advantageous embodiment of the invention, each joint arrangement encompasses two joint units, which are arranged spaced apart from one another relative to the transverse direction of the chair and which are mechanically coupled to one another such that a movement of the one joint unit effects a movement of the other joint unit. It is effected by means of this mechanical coupling that the seat support cannot be tilted about an axis, which is oriented in longitudinal direction of the chair. Preferably, the seat support is embodied in a substantially right-angled manner relative to the horizontal, wherein one of the joint units is arranged in each corner area of the seat support.

A further advantageous embodiment provides for each front joint unit to encompass two elements, which are connected to one another on one end in an articulated manner via a free first axis, the upper element of which is connected to the base unit and the seat support in an articulated manner on the other end via a second axis and the lower element is connected to the base unit in an articulated manner on the other end via a third axis, wherein the free first, the second and the third axes are arranged parallel to and spaced apart from the pivot axis, wherein the second axis is guided in vertical direction on the end side in elongated holes on the base unit, wherein the free first axis is arranged in front of the second and the third axes, and wherein the free first, the second and the third axes of the one front joint unit form the free first, the second and the third axes of the other front joint unit. This represents a constructively simple and yet robust embodiment of the front joint units.

It is furthermore considered to be advantageous when each rear joint unit encompasses two elements, which are connected to one another in an articulated manner on one end via a free fourth axis, the upper element of which is connected to the base unit in an articulated manner on the other end via a fifth axis and the lower element is connected to the base unit in an articulated manner on the other end via a sixth axis, wherein the free fourth, the fifth and the sixth axes are arranged parallel to and spaced apart from the pivot axis, wherein the sixth axis is guided in vertical direction on the end side in elongated holes on the base unit, wherein the free fourth axis is arranged behind the fifth and the sixth axes and wherein the free fourth, the fifth and the sixth axes of the one rear joint unit form the free fourth, the fifth and the sixth axes of the other rear joint unit. According to this, the rear joint units are also embodied in a constructively simple and robust manner.

According to a further advantageous embodiment of the invention, each rear joint unit encompasses a coupling element, which is connected to the seat support in an articulated manner on one end via a seventh axis and to the base unit in an articulated manner on the other end via the sixth axis, wherein the seventh axis of the one rear joint unit forms the seventh axis of the other rear joint unit. The coupling element is thus connected to the joint units of the rear joint arrangement via the sixth axis. Movements of the seat support act on the rear joint units via the coupling element. Preferably, one of the coupling elements is arranged in each corner area of a seat support, which is embodied in a substantially right-angled manner relative to the horizontal.

It is furthermore proposed for the free first axis to be connected to the free fourth axis via at least one rigidly embodied control element. The arrangement of the control element effects the mechanical coupling of front joint arrangement and rear joint arrangement. Preferably, provision is made for two control elements, which are arranged in longitudinal direction of the chair and via which the front joint unit, which is in each case arranged on one side of the seat support, is connected to the rear joint unit arranged on this side.

Preferably, the intensity of the prestressing force, which is exerted by the prestressing device, can be adjusted. Because of this, a highly individual adjustment of the sitting comfort can be made by the user of the synchronous mechanism or of a chair, which is equipped with it, respectively.

Advantageously, the prestressing device comprises at least one pressure spring arrangement, which is supported on the bottom side of the seat support and on the upper side of a section of the backrest support, which extends forwards beyond the pivot axis. Depending on the application, provision can also be made for two or a plurality of pressure spring arrangements.

In the alternative or in addition to the last-mentioned embodiment, the prestressing device can comprise at least one tension spring, which engages with one end on the free first axis and with the other end on the backrest support such that it presses the free first axis in the direction of the rear joint arrangement and the backrest support forwards. Depending on the application, provision can also be made here for two or a plurality of tension springs. The two joint units of the front joint arrangement are preferably raised by means of the force of the tension spring, and are transferred into a state, which corresponds to the unstressed state of the synchronous mechanism.

The invention additionally proposes a chair, in particular an office chair, which, according to the invention, is equipped with a synchronous mechanism according to any one of the afore-described embodiments or any combination thereof. The advantages described above with reference to the synchronous mechanism are associated therewith.

Further advantages and features of the instant invention will be defined in more detail by means of the exemplary embodiment for the synchronous mechanism according to the invention shown in the enclosed figures.

DETAILED DESCRIPTION OF THE PREFERRED EMBODIMENTS

Figure 1:
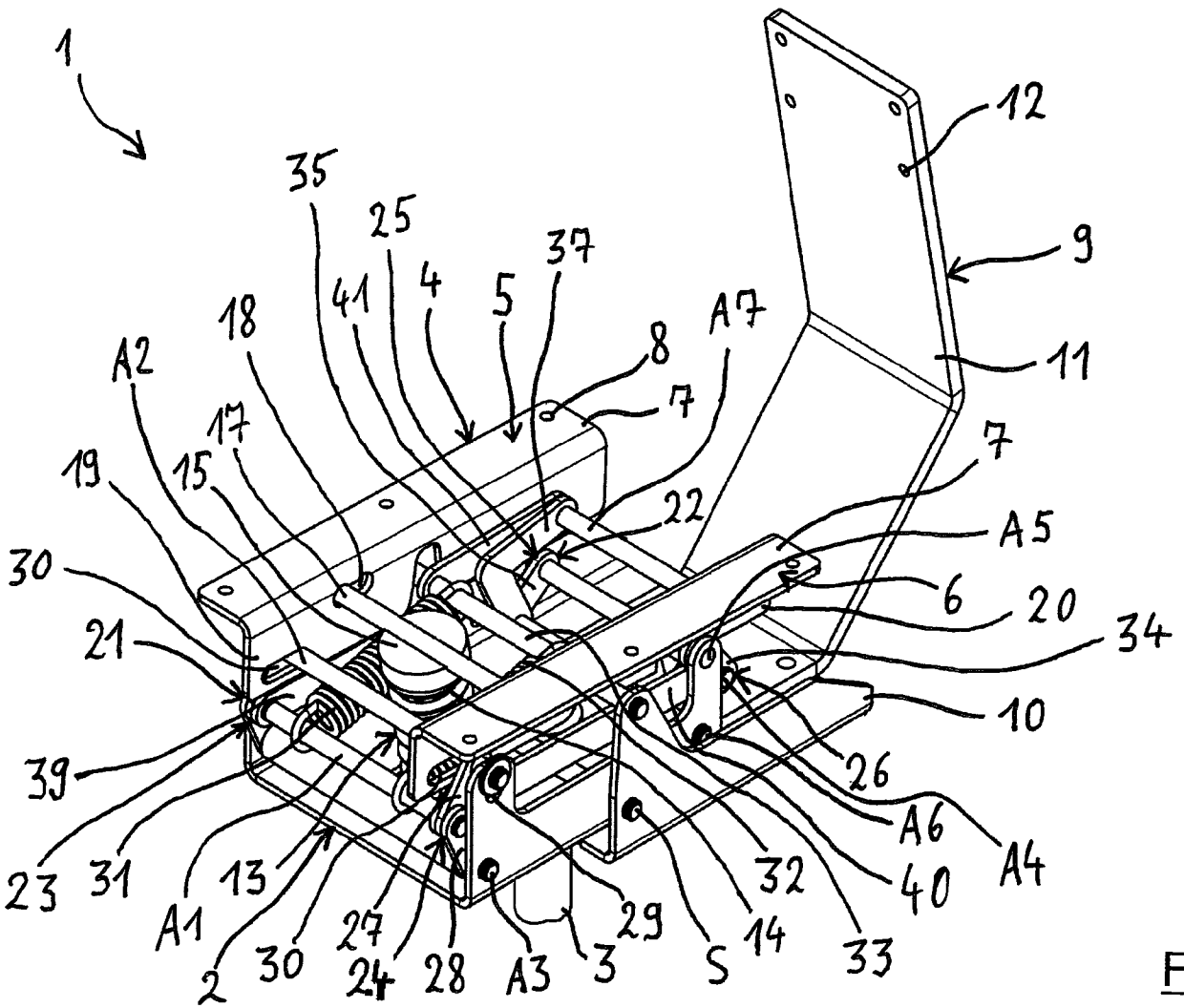
FIG. 1 shows a perspective illustration of an exemplary embodiment for the synchronous mechanism according to the invention in unstressed state comprising a raised backrest support.

FIG. 1 shows an exemplary embodiment for the synchronous mechanism 1 according to the invention for a partially-illustrated chair, in particular office chair in the unstressed state. The synchronous mechanism 1 encompasses a base unit 2, via which the synchronous mechanism 1 is connected to a central chair column 3.

The synchronous mechanism 1 furthermore comprises a seat support 4, which is arranged above and movably on the base unit 2 and which is embodied in two pieces according to the exemplary embodiment and which encompasses the seat support elements 5 and 6, which are embodied as metal profiles, which are angled in a right-angled manner. Boreholes 8, via which a phantomly-illustrated seat can be connected to the seat support 4, for example by means of screwing, are arranged on the upper section 7 of the seat support elements 5 and 6, which extends substantially horizontally.

The synchronous mechanism 1 furthermore encompasses a backrest support 9, which is arranged on the base unit 2 so as to be pivotable about a pivot axis S, which is oriented horizontally and in transverse direction of the chair, and which comprises a connecting part 10, which is connected directly to the pivot axis S and a back part 11 connected thereto, wherein boreholes 12, via which a phantomly-illustrated backrest can be connected to the backrest support 9, are also embodied on the back part 11.

Figure 2:
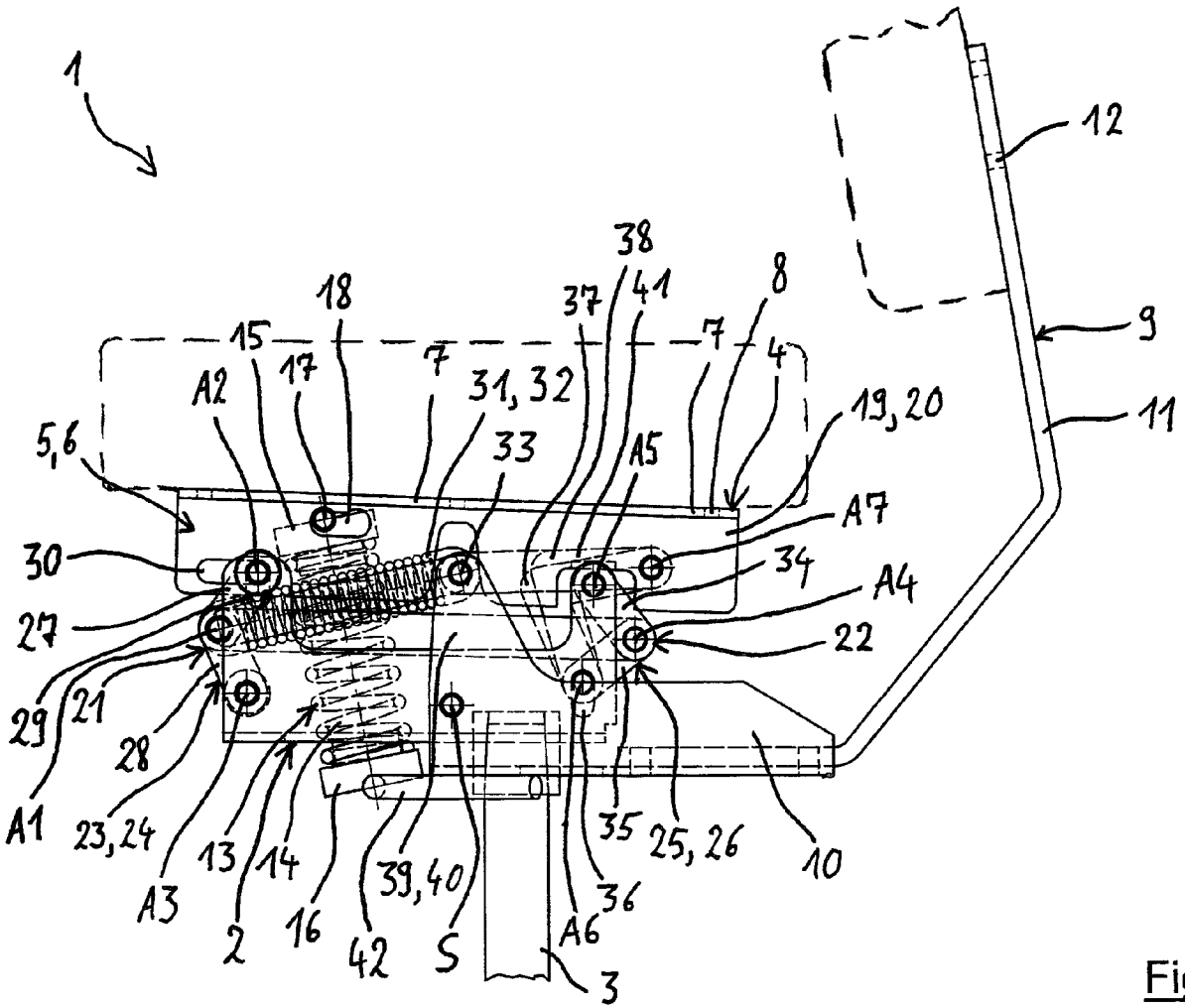
FIG. 2 shows a transparent illustration of the exemplary embodiment shown in FIG. 1 from the transverse direction of the chair.

The synchronous mechanism 1 further comprises a pressure spring arrangement 13, which is supported on the bottom side of the seat support 4 and which exerts an upwards prestressing force onto the seat support 4 and a forwards prestressing force on the backrest support 9. The pressure spring arrangement 13 encompasses a pressure spring 14, an upper bearing element 15 and a lower bearing element 16, which is shown in FIG. 2. The pressure spring 14 is supported via the upper bearing element 15 on the bottom side of a transverse bar 17 of the seat support 4, which are embodied on the end side in elongated holes 18 on the sections 19 or 20, respectively, of the seat support elements 5 or 6, respectively, which are oriented in vertical direction. The elongated holes 19 and 20 are embodied such that they can be adjusted via at least two different prestressing forces, which takes place in the shown exemplary embodiment in that the transverse bar 18 is moved up against the one or the other end of the elongated holes. In the shown position of the transverse bar, a smaller prestressing force is set. The seat support 4 is connected to the base unit 2, which will be explained in more detail below, via a coupling mechanism, which provides for the movability of the seat support 4 relative to the base unit 2.

The coupling mechanism encompasses a front joint arrangement 21, which is arranged in the front area of the seat support 4, and a rear joint arrangement 22, which is arranged in the rear area of the seat support 4. The front joint arrangement 21 and the rear joint arrangement 22 are coupled to one another mechanically such that a movement of the front joint arrangement 21 effects a movement of the rear joint arrangement 22 and vice versa, which becomes clear from the following. Because of this, the seat support 4 is prevented from tilting about an axis, which is oriented in transverse direction of the chair and which is not identified in detail.

Each joint arrangement 21 or 22, respectively, encompasses two joint units 23 and 24 or 25 and 26, respectively, which are arranged spaced apart from one another relative to the transverse direction of the chair and which are coupled to one another mechanically such that a movement of the one joint unit 23 or 25, respectively, effects a movement of the other joint unit 24 or 26, respectively. With this mechanical coupling, tilting of the seat support 4 is avoided about an axis which is oriented in longitudinal direction of the chair and which is not identified in more detail, in response to an asymmetrical weight-loading.

To maintain the clarity of the figures, the embodiment of the front joint units 23 and 24 is only described by means of the front joint unit 24. The front joint unit 24 encompasses two elements 27 and 28, which are connected to one another in an articulated manner on one end via a free first axis A1. The upper element 27 is connected to the base unit 2 and to the seat support 4 in an articulated manner on the other end via a second axis A2, and the lower element 28 is connected to the base unit 2 in an articulated manner on the other end via a third axis A3. The free first axis A1, the second axis A2 and the third axis A3 are arranged parallel to and spaced apart from the pivot axis S. The second axis A2 is guided in vertical direction on the end side in elongated holes 29 on the base unit 2, whereby the movability of the seat support 4 is defined in vertical direction relative to the base unit 2. The second axis A2 is furthermore guided in horizontal elongated holes 30 on the vertically oriented sections 19 and 20 of the seat support elements 5 and 6, the function of which becomes clear from FIGS. 5 to 8. The free first axis A1 is arranged in front of the second axis A2 and the third axis A3. The free first axis A1, the second axis A2 and the third axis A3 of the one front joint unit 23 form the free first axis A1, the second axis A2 and the third axis A3 of the other front joint unit 24. Two tension springs 31 and 32, the other ends of which interact with a transverse bar 33, which is fixed to the connecting part 10 of the backrest support 9, engage with the free first axis A1. A force is applied to the first free axis A1 by means of the tension springs 31 and 32 such that the front joint units 23 and 24 aim to straighten.

Each rear joint unit 25 or 26, respectively, encompasses two elements 34 and 35, which are connected to one another in an articulated manner on one end via a free fourth axis A4, which becomes clearer from FIG. 2. The upper element 34 is connected to the base unit 2 in an articulated manner on the other end via a fifth axis A5 and the lower element 35 is connected to the base unit 2 in an articulated manner on the other end via a sixth axis A6. The free fourth axis A4, the fifth axis A5 and the sixth axis A6 are arranged parallel to and spaced apart from the pivot axis S. The sixth axis A6 is guided in vertical direction on the end side in elongated holes on the base unit 2. The free fourth axis A4 is arranged behind the fifth axis A5 and the sixth axis A6. The free fourth axis A4, the fifth axis A5 and the sixth axis A6 of the one rear joint unit 25 or 26, respectively, form the free fourth axis A4, the fifth axis A5 and the sixth axis A6 of the other rear joint unit 26 or 25, respectively.

Each rear joint unit 25 or 26, respectively, further encompasses a coupling element 37 or 38, respectively, only the coupling element 37 of which can be seen in FIG. 1. Each coupling element 37 or 38, respectively, is connected to the seat support 4 in an articulated manner on the one end via a seventh axis A7 and to the base unit 2 in an articulated manner on the other end via the sixth axis A6. The seventh axis A7 of the one rear joint unit 25 or 26, respectively, forms the seventh axis A7 of the other rear joint unit 26 or 25, respectively. The seventh axis A7 is connected to the transverse bar 33 via two rockers 41. The coupling elements 37 and 38 are thus connected to the rear elements 34 and 35 via the sixth axis A6. Movements of the seat support 4 act on the rear joint units 25 and 26 via the coupling elements 37 and 38.

To mechanically couple the front joint arrangement 21 to the rear joint arrangement 22, the free first axis A1 is connected to the free fourth axis A4 via two rigidly embodied control elements 39 and 40.

The mode of operation of the above-described coupling mechanism and thus of the synchronous mechanism 1 will be described below in a synopsis of FIGS. 1 to 4:

As is shown in FIGS. 1 and 2, the second axis A2, in the unstressed state of the synchronous mechanism 1, is located on the upper stop of the elongated holes 29 on the base unit 2. The sixth axis A6 is also located on the upper stop of the elongated holes 36, which are embodied in the base unit 2. A prestressing force, which acts upwards, acts on the seat support 4 by means of the pressure spring arrangement 13. For this purpose, the pressure spring 14 is supported on a thrust bearing element 42, which is fastened to the connecting part 10 of the backrest support 9, via the lower bearing element 16.

Figure 3:
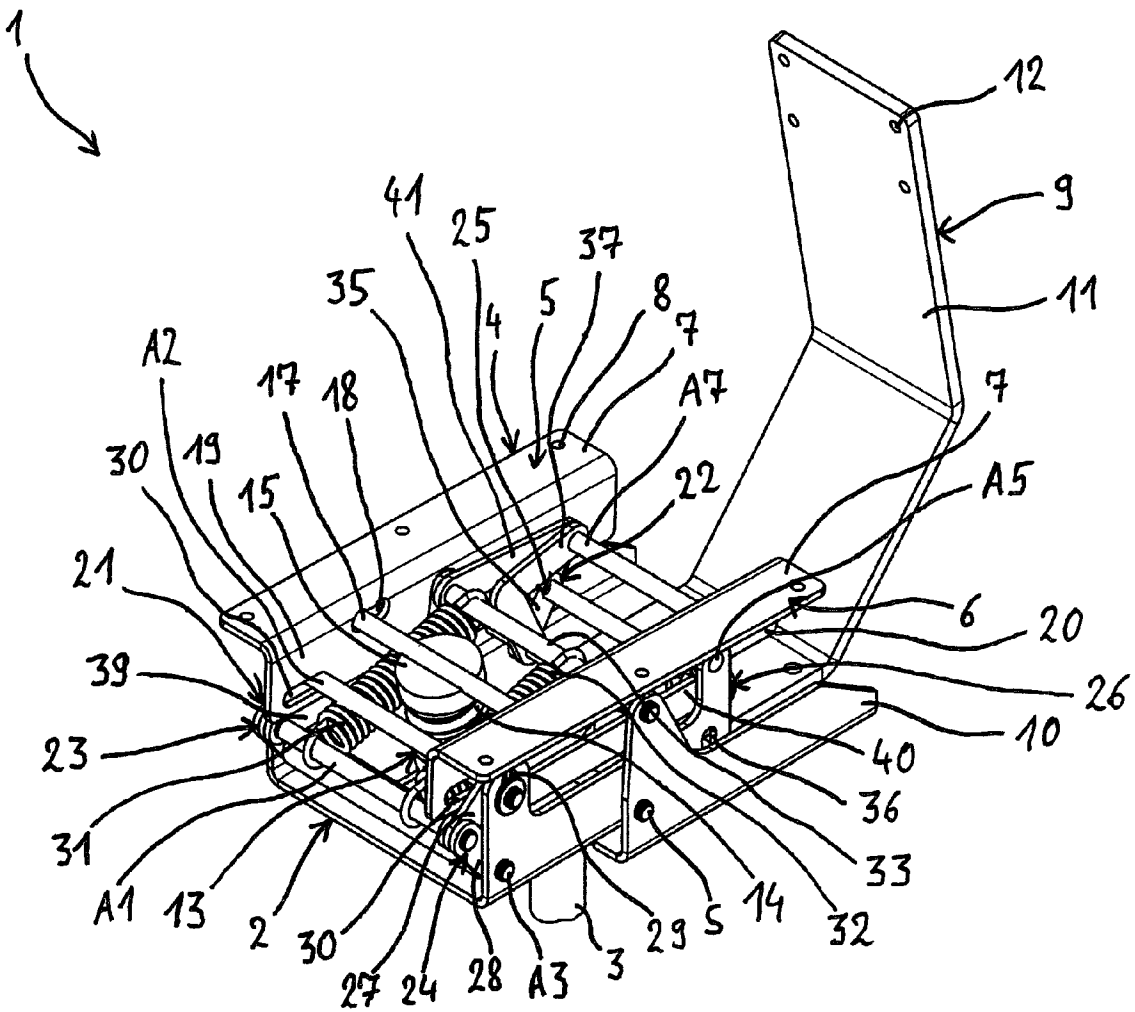
FIG. 3 shows a perspective illustration of an exemplary embodiment for the synchronous mechanism according to the invention in the stressed state comprising a raised backrest support.
Figure 4:
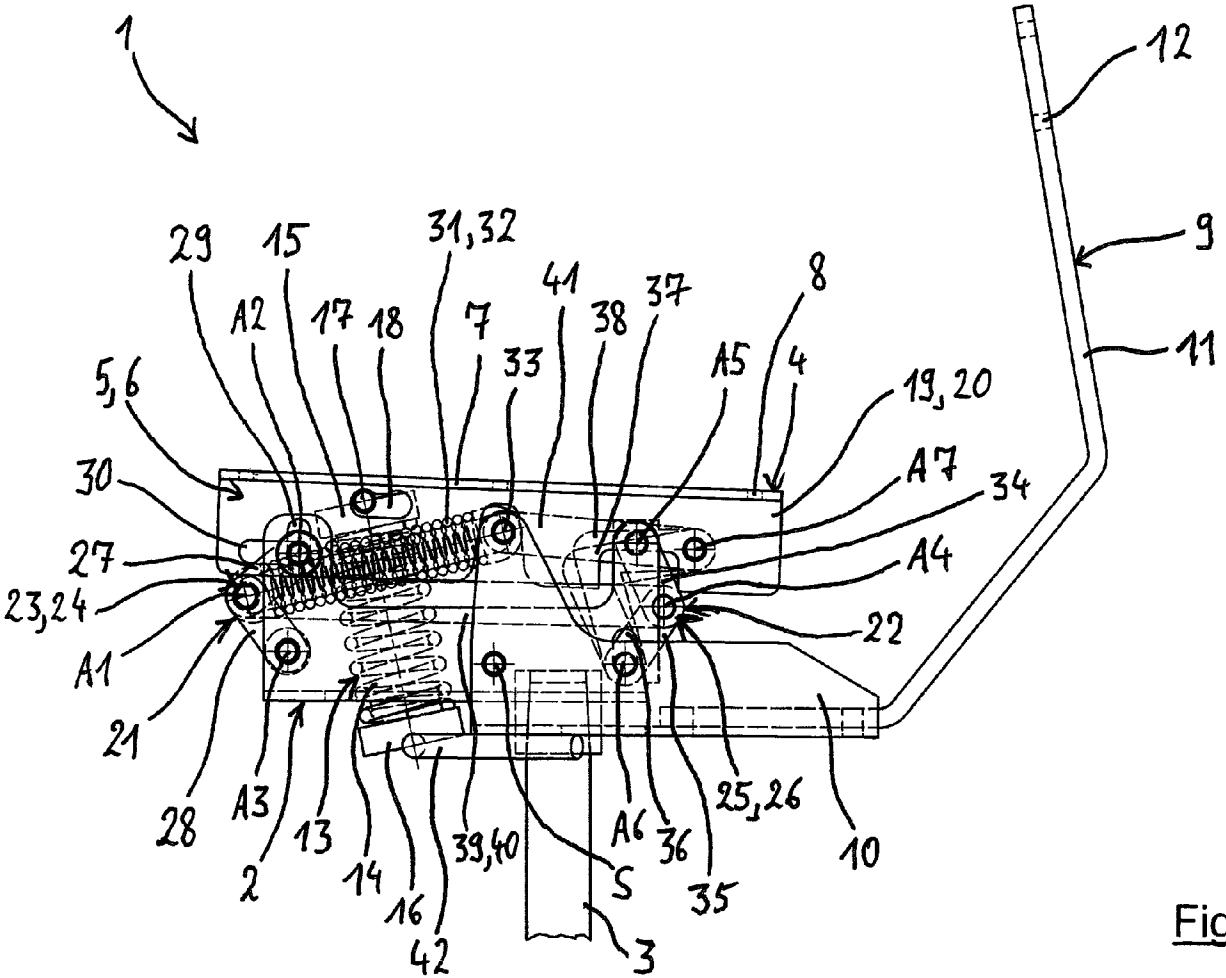
FIG. 4 shows a transparent illustration of the exemplary embodiment shown in FIG. 3 from the transverse direction of the chair.
Figure 5:
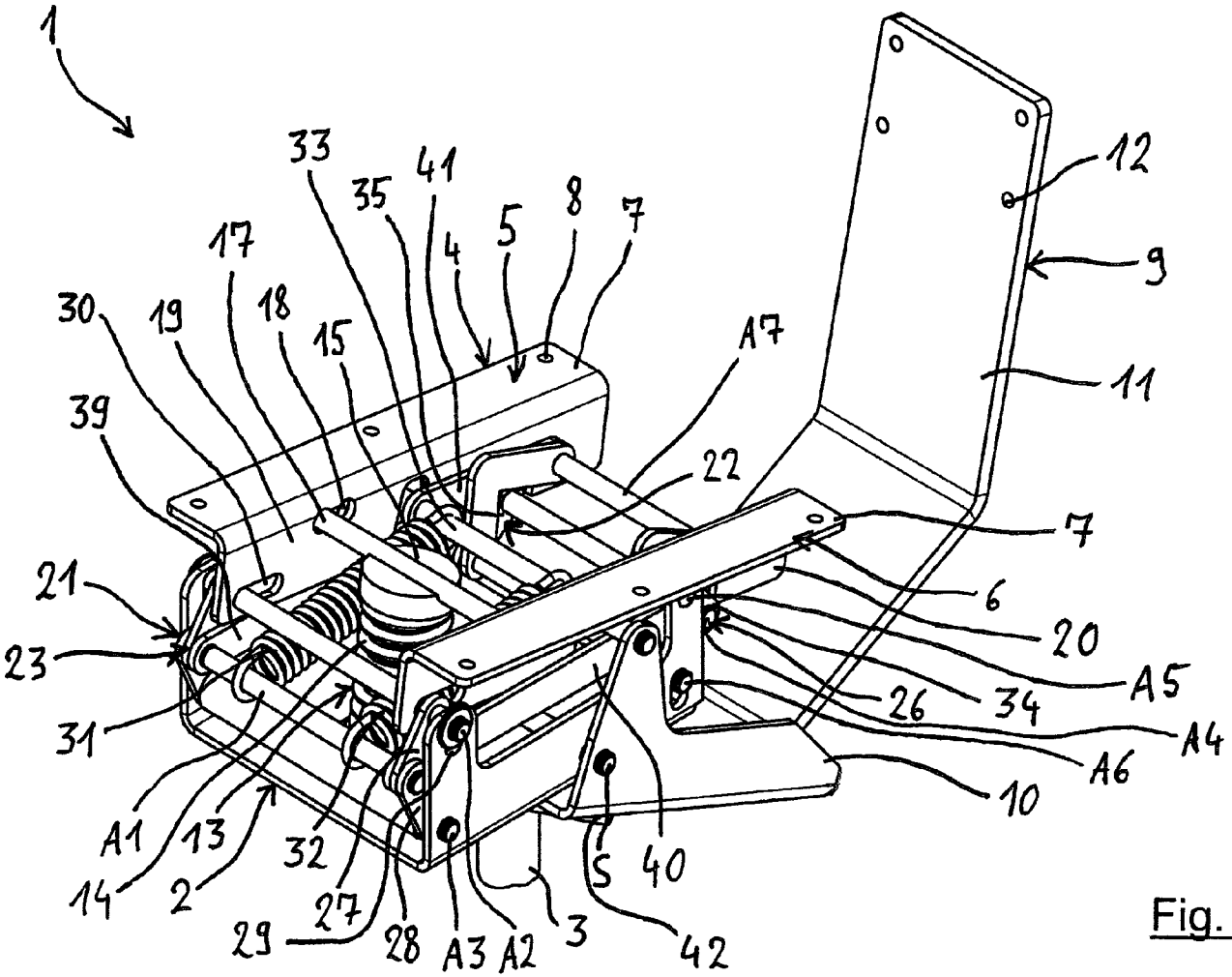
FIG. 5 shows a perspective illustration of an exemplary embodiment for the synchronous mechanism according to the invention in the unstressed state comprising a backrest support, which is tilted backwards.
Figure 6:
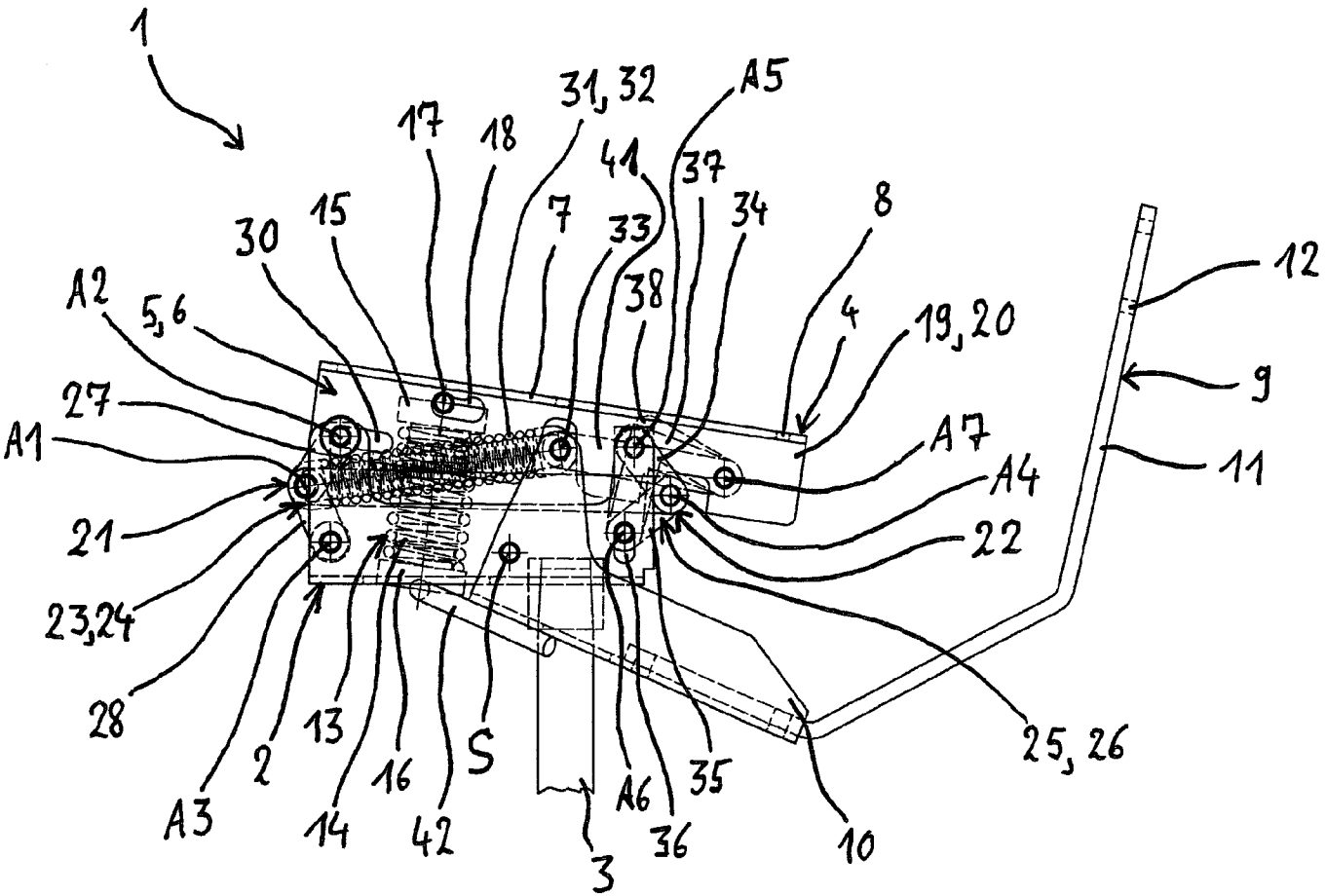
FIG. 6 shows a transparent illustration of the exemplary embodiment shown in FIG. 5 from the transverse direction of the chair.
Figure 7:
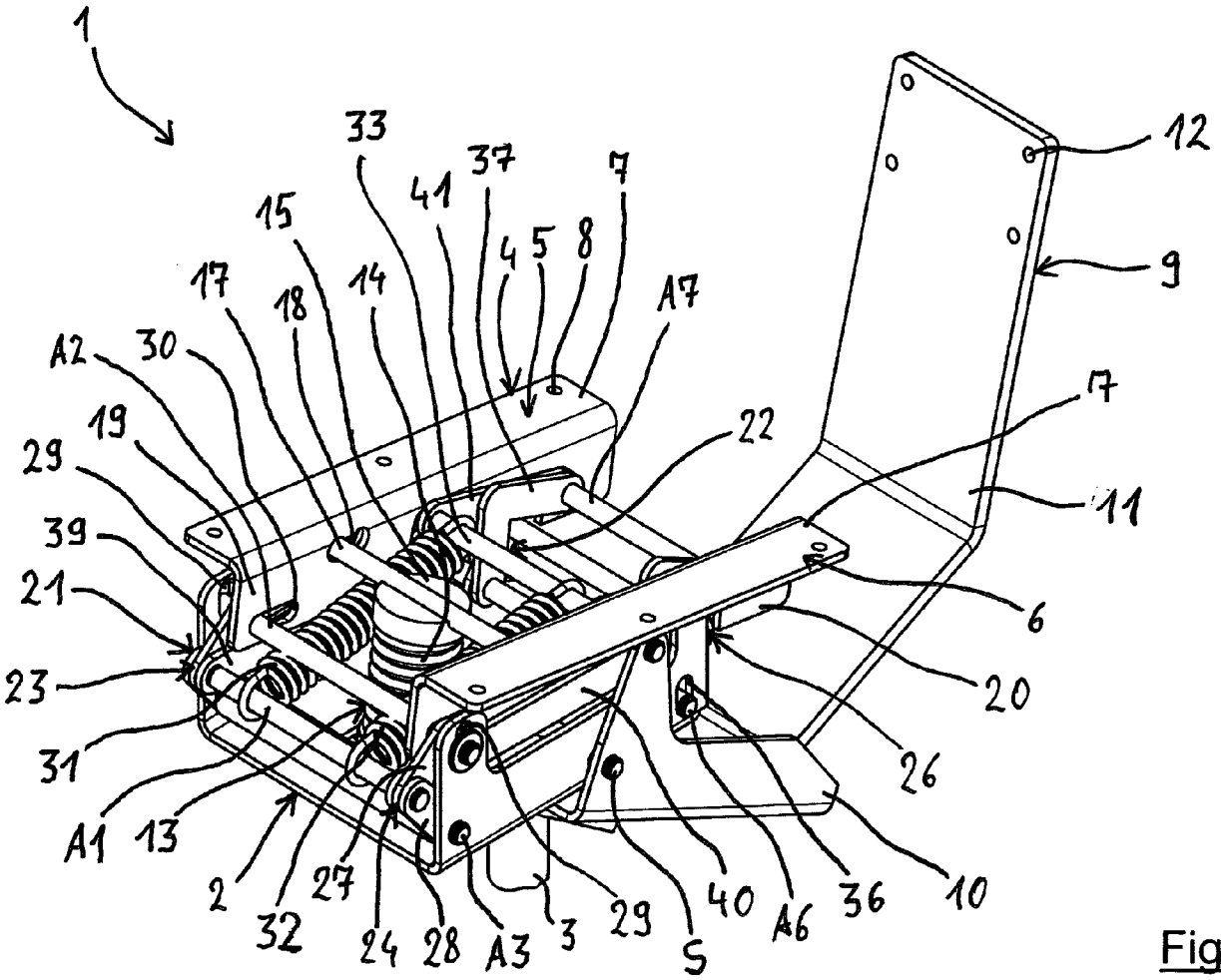
FIG. 7 shows a perspective illustration of an exemplary embodiment for the synchronous mechanism according to the invention in the stressed state comprising a backrest support, which is tilted backwards.
Figure 8:
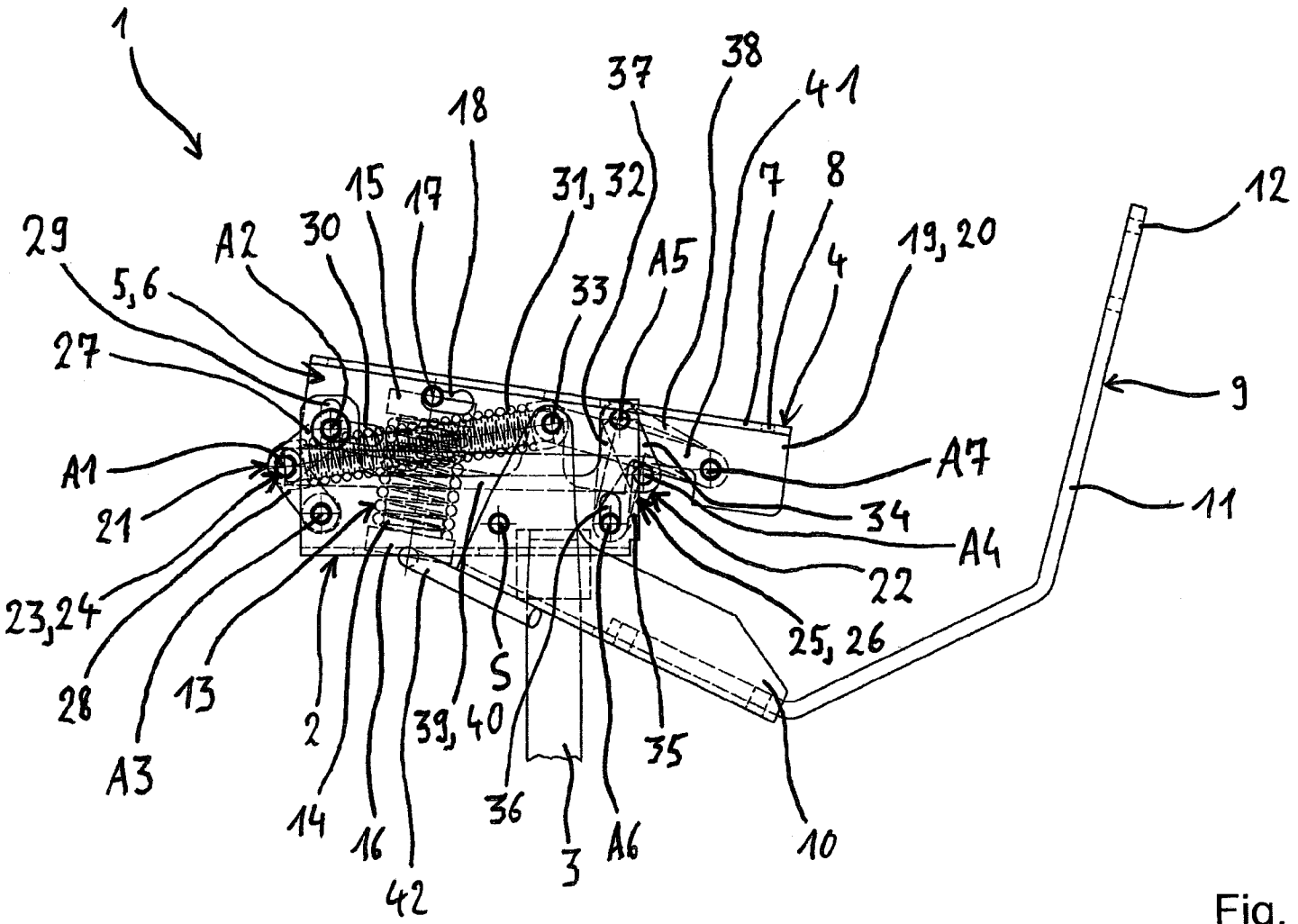
FIG. 8 shows a transparent illustration of the exemplary embodiment shown in FIG. 7 from the transverse direction of the chair.

In the event that the seat support 4 is stressed with a weight, which is to be suggested in FIGS. 3 and 4, the pressure spring 14 of the pressure spring arrangement 13 is compressed. The second axis A2 and the sixth axis A6 are simultaneously displaced downwards in the respective elongated holes 29 or 36, respectively. These movements are mechanically coupled to one another by means of the control elements 39 and 40. In the event that the front joint unit 24, for example, is actuated by means of weight-loading of the seat support 4, the first free axis A1 in FIGS. 2 and 4 moves to the left. Because of this, the free fourth axis A4 is also moved to the left via the control elements 39 and 40, which, in turn, effects a movement of the sixth axis A6 downwards in the elongated holes 36. The coupling elements 37 and 38 are hereby entrained, which, in turn, entrain the seat support 4 and thus effect a displacement of the rear part of the seat support 4, which is shown on the right in FIGS. 2 and 4, so that a parallel displacement of the entire seat support 4 takes place relative to the base unit 2. An actuation of the front joint units 23 and 24, so to speak, takes place in mechanical reversal in response to an actuation of the rear joint units 25 and 26, so as to effect an exclusively parallel displacement of the entire seat support 4.

FIGS. 5 to 8 show the exemplary embodiment for the synchronous mechanism 1 shown in FIGS. 1 to 4 with the backrest support 9 being pivoted backwards. In this state of the synchronous mechanism 1, the second axis A2 is located on the front stop of the elongated holes 30 in the vertical sections 19 and 20 of the seat support elements 5 or 6, respectively. At the same time, the tension springs 31 and 32 are stretched. The actuating mechanism of the front joint units 23 and 24 and of the rear joint units 25 and 26 corresponds to what has been described above with reference to FIGS. 1 to 4.

Figure 9:
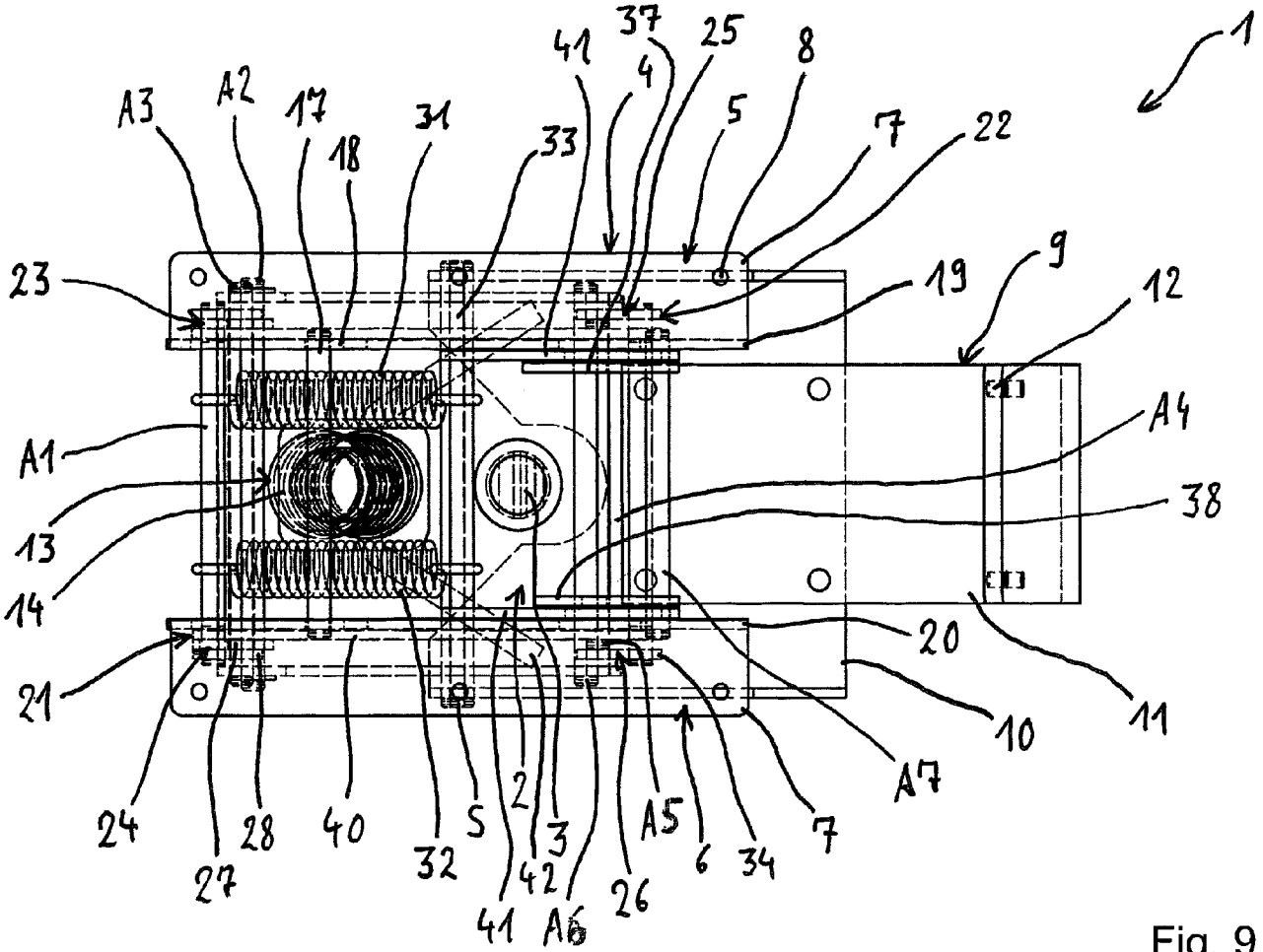
FIG. 9 shows a transparent illustration of the exemplary embodiment shown in FIG. 1 from the top.

FIG. 9 shows the exemplary embodiment for the synchronous mechanism 1 according to the invention shown in FIGS. 1 to 4 in a transparent illustration from the top and once again clarifies the spatial arrangement of the components of the synchronous mechanism 1 relative to one another.

The exemplary embodiment described by means of the figures serves to explain and does not form a limitation. In particular, the tension springs 31 and 32 can be designed such that they take over the same function as the compression spring arrangement 13 or even replace it.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A synchronous mechanism for a chair, comprising:

a base unit, a seat support, which is arranged above and moveably on the base unit, a backrest support which is arranged on the base unit so as to be capable of being pivoted about a pivot axis, which is oriented horizontally and in transverse direction of the chair, and a prestressing device, wherein the prestressing device exerts a prestressing force, which acts upwards on the seat support and forwards on the backrest support, and wherein the seat support is connected to the base unit via a coupling mechanism, which provides for the movability of the seat support relative to the base unit, and the coupling mechanism being arranged such that it positively controls the movements of the seat support relative to the base unit such that the seat support can be moved back and forth solely between positions, which are parallel to one another, when the backrest support is fixed, wherein the coupling mechanism encompasses a front joint arrangement which is arranged in a front area of the seat support, and a rear joint arrangement, which is arranged in a rear area of the seat support, wherein the front joint arrangement and the rear joint arrangement are coupled to one another mechanically such that a movement of the front joint arrangement effects a movement of the rear joint arrangement and vice versa, wherein each joint arrangement encompasses two joint units, which are arranged spaced apart from one another relative to the transverse direction of the chair, and which are mechanically coupled to one another such that a movement of the one joint unit effects a movement of the other joint unit, and wherein each front joint unit comprises an upper element and a lower element, which are connected to one another on one end in an articulated manner via a free first axis, the upper element is connected to the base unit and the seat support in an articulated manner on the other end via a second axis and the lower element is connected to the base unit in an articulated manner on the other end via a third axis, wherein the free first axis, the second axis and the third axis are arranged parallel to and spaced apart from the pivot axis, wherein the second axis is guided in vertical direction on the end side in elongated holes on the base unit, wherein the free first axis is arranged in front of the second axis and the third axis, and wherein the free first axis, the second axis and the third axis of the one front joint unit form the free first axis, the second axis and the third axis of the other front joint unit.

2. A synchronous mechanism for a chair, comprising:

a base unit, a seat support, which is arranged above and moveably on the base unit, a backrest support which is arranged on the base unit so as to be capable of being pivoted about a pivot axis, which is oriented horizontally and in transverse direction of the chair, and a prestressing device, wherein the prestressing device exerts a prestressing force, which acts upwards on the seat support and forwards on the backrest support, and wherein the seat support is connected to the base unit via a coupling mechanism, which provides for the movability of the seat support relative to the base unit, and the coupling mechanism being arranged such that it positively controls the movements of the seat support relative to the base unit such that the seat support can be moved back and forth solely between positions, which are parallel to one another, when the backrest support is fixed, wherein the coupling mechanism encompasses a front joint arrangement which is arranged in a front area of the seat support, and a rear joint arrangement, which is arranged in a rear area of the seat support, wherein the front joint arrangement and the rear joint arrangement are coupled to one another mechanically such that a movement of the front joint arrangement effects a movement of the rear joint arrangement and vice versa, wherein each joint arrangement encompasses two joint units, which are arranged spaced apart from one another relative to the transverse direction of the chair, and which are mechanically coupled to one another such that a movement of the one joint unit effects a movement of the other joint unit, and wherein each rear joint unit comprises an upper element and a lower element which are connected to one another in an articulated manner on one end via a free fourth axis, and the upper element is connected to the base unit in an articulated manner on the other end via a fifth axis and the lower element is connected to the base unit in an articulated manner on the other end via a sixth axis, wherein the free fourth axis, the fifth axis and the sixth axis are arranged parallel to and spaced apart from the pivot axis, wherein the sixth axis is guided in vertical direction on the end side in elongated holes on the base unit, wherein the free fourth axis is arranged behind the fifth axis and the sixth axis and wherein the free fourth axis, the fifth axis and the sixth axis of the one rear joint unit form the free fourth axis, the fifth axis and the sixth axis of the other rear joint unit.

3. The synchronous mechanism according to claim 2, wherein each rear joint unit comprises a coupling element which is connected to the seat support in an articulated manner on one end via a seventh axis and to the base unit in an articulated manner on the other end via the sixth axis, wherein the seventh axis of the one rear joint unit forms the seventh axis of the other rear joint unit.

4. The synchronous mechanism according to claim 3, wherein the prestressing device comprises at least one pressure spring arrangement which is supported on the bottom side of the seat support and on the upper side of a section of the backrest support, which extends forwards beyond the pivot axis.

5. The synchronous mechanism according to claim 2, wherein the free first axis is connected to the free fourth axis via at least one rigidly embodied control element.

6. The synchronous mechanism according to claim 2, wherein the intensity of the prestressing force, which is exerted by the prestressing device, is adjustable.

7. The synchronous mechanism according to claim 1, wherein the intensity of the prestressing force, which is exerted by the prestressing device, is adjustable.

8. The synchronous mechanism according to claim 1, wherein the prestressing device comprises at least one pressure spring arrangement which is supported on the bottom side of the seat support and on the upper side of a section of the backrest support, which extends forwards beyond the pivot axis.

9. The synchronous mechanism according to claim 1, wherein the prestressing device comprises at least one tension spring which engages with one end on the free first axis and with the other end on the backrest support such that it presses the free first axis in the direction of the rear joint arrangement and presses the backrest support forwards.

10. A chair comprising:

a synchronous mechanism, comprising:

a base unit, a seat support, which is arranged above and moveably on the base unit, a backrest support which is arranged on the base unit so as to be capable of being pivoted about a pivot axis, which is oriented horizontally and in transverse direction of the chair, and a prestressing device, wherein the prestressing device exerts a prestressing force, which acts upwards on the seat support and forwards on the backrest support, and wherein the seat support is connected to the base unit via a coupling mechanism, which provides for the movability of the seat support relative to the base unit, and the coupling mechanism being arranged such that it positively controls the movements of the seat support relative to the base unit such that the seat support can be moved back and forth solely between positions, which are parallel to one another, when the backrest support is fixed, wherein the coupling mechanism encompasses a front joint arrangement which is arranged in a front area of the seat support, and a rear joint arrangement, which is arranged in a rear area of the seat support, wherein the front joint arrangement and the rear joint arrangement are coupled to one another mechanically such that a movement of the front joint arrangement effects a movement of the rear joint arrangement and vice versa, wherein each joint arrangement encompasses two joint units, which are arranged spaced apart from one another relative to the transverse direction of the chair, and which are mechanically coupled to one another such that a movement of the one joint unit effects a movement of the other joint unit, and wherein each front joint unit comprises an upper element and a lower element, which are connected to one another on one end in an articulated manner via a free first axis, the upper element is connected to the base unit and the seat support in an articulated manner on the other end via a second axis and the lower element is connected to the base unit in an articulated manner on the other end via a third axis, wherein the free first axis, the second axis and the third axis are arranged parallel to and spaced apart from the pivot axis, wherein the second axis is guided in vertical direction on the end side in elongated holes on the base unit, wherein the free first axis is arranged in front of the second axis and the third axis, and wherein the free first axis, the second axis and the third axis of the one front joint unit form the free first axis, the second axis and the third axis of the other front joint unit.

11. The chair according to claim 10, wherein the chair is an office chair.

12. A chair comprising:

a synchronous mechanism, comprising:

a base unit, a seat support, which is arranged above and moveably on the base unit, a backrest support which is arranged on the base unit so as to be capable of being pivoted about a pivot axis, which is oriented horizontally and in transverse direction of the chair, and a prestressing device, wherein the prestressing device exerts a prestressing force, which acts upwards on the seat support and forwards on the backrest support, and wherein the seat support is connected to the base unit via a coupling mechanism, which provides for the movability of the seat support relative to the base unit, and the coupling mechanism being arranged such that it positively controls the movements of the seat support relative to the base unit such that the seat support can be moved back and forth solely between positions, which are parallel to one another, when the backrest support is fixed, wherein the coupling mechanism encompasses a front joint arrangement which is arranged in a front area of the seat support, and a rear joint arrangement, which is arranged in a rear area of the seat support, wherein the front joint arrangement and the rear joint arrangement are coupled to one another mechanically such that a movement of the front joint arrangement effects a movement of the rear joint arrangement and vice versa, wherein each joint arrangement encompasses two joint units, which are arranged spaced apart from one another relative to the transverse direction of the chair, and which are mechanically coupled to one another such that a movement of the one joint unit effects a movement of the other joint unit, and wherein each rear joint unit comprises an upper element and a lower element which are connected to one another in an articulated manner on one end via a free fourth axis, and the upper element is connected to the base unit in an articulated manner on the other end via a fifth axis and the lower element is connected to the base unit in an articulated manner on the other end via a sixth axis, wherein the free fourth axis, the fifth axis and the sixth axis are arranged parallel to and spaced apart from the pivot axis, wherein the sixth axis is guided in vertical direction on the end side in elongated holes on the base unit, wherein the free fourth axis is arranged behind the fifth axis and the sixth axis and wherein the free fourth axis, the fifth axis and the sixth axis of the one rear joint unit form the free fourth axis, the fifth axis and the sixth axis of the other rear joint unit.

13. The chair according to claim 12, wherein each rear joint unit comprises a coupling element which is connected to the seat support in an articulated manner on one end via a seventh axis and to the base unit in an articulated manner on the other end via the sixth axis, wherein the seventh axis of the one rear joint unit forms the seventh axis of the other rear joint unit.

14. The chair according to claim 12, wherein the free first axis is connected to the free fourth axis via at least one rigidly embodied control element.

15. The chair according to claim 12, wherein the chair is an office chair.

16. The chair according to claim 12, wherein the prestressing device comprises at least one pressure spring arrangement which is supported on the bottom side of the seat support and on the upper side of a section of the backrest support, which extends forwards beyond the pivot axis.

17. The chair according to claim 12, wherein the prestressing device comprises at least one tension spring which engages with one end on the free first axis and with the other end on the backrest support such that it presses the free first axis in the direction of the rear joint arrangement and presses the backrest support forwards.

18. The chair according to claim 10, wherein the prestressing device comprises at least one pressure spring arrangement which is supported on the bottom side of the seat support and on the upper side of a section of the backrest support, which extends forwards beyond the pivot axis.

19. The chair according to claim 10, wherein the prestressing device comprises at least one tension spring which engages with one end on the free first axis and with the other end on the backrest support such that it presses the free first axis in the direction of the rear joint arrangement and presses the backrest support forwards.

* * * * *